US010935049B2

(12) United States Patent
Yasuda et al.

(10) Patent No.: US 10,935,049 B2
(45) Date of Patent: Mar. 2, 2021

(54) AXIAL OUTLET CENTRIFUGAL-TYPE BLOWER DEVICE WITH NOISE REDUCING SPACE

(71) Applicant: DENSO CORPORATION, Kariya (JP)

(72) Inventors: Masanori Yasuda, Nisshin (JP); Shouichi Imahigashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 52 days.

(21) Appl. No.: 16/361,315

(22) Filed: Mar. 22, 2019

(65) Prior Publication Data

US 2019/0309767 A1 Oct. 10, 2019

(30) Foreign Application Priority Data

Apr. 6, 2018 (JP) ..... JP2018-73957

(51) Int. Cl.

| | |
|---|---|
| ***F04D 29/66*** | (2006.01) |
| ***F04D 17/16*** | (2006.01) |
| ***F04D 29/42*** | (2006.01) |
| ***F04D 25/08*** | (2006.01) |

(52) U.S. Cl.

CPC ..... *F04D 29/665* (2013.01); *F04D 17/165* (2013.01); *F04D 25/08* (2013.01); *F04D 29/4253* (2013.01); *F05B 2260/96* (2013.01)

(58) Field of Classification Search

CPC .. F04D 17/00–08; F04D 17/16; F04D 17/165; F04D 29/4253; F04D 29/663; F04D 29/665; F05B 2260/96

See application file for complete search history.

(56) References Cited

U.S. PATENT DOCUMENTS 3,101,890 A * 8/1963 Carlson ..... F04D 17/165 415/115
3,243,102 A * 3/1966 McMahan ..... F04D 29/441 415/208.2
5,813,831 A * 9/1998 Matsunaga ..... F04D 29/4213 415/173.6

(Continued)

FOREIGN PATENT DOCUMENTS

CN 106194797 A * 12/2016
FR 1416716 A * 11/1965 ..... F04D 17/165

(Continued)

*Primary Examiner* — Eldon T Brockman
*Assistant Examiner* — Topaz L. Elliot
(74) *Attorney, Agent, or Firm* — Harness, Dickey & Pierce, P.L.C.

(57) ABSTRACT

A bladed wheel of a blower device has a main plate, a side plate and multiple fan blades between the main plate and the side plate. A fan casing of the blower device has a bell mouth portion and a guide wall portion, which extends in a radial-outward direction from an axial rear-side end of the bell mouth portion to an outer periphery of the side plate. An air reflecting space is formed in the fan casing at a radial-outside position of the guide wall portion and at an axial front-side position of the fan casing between an axial rear-side end of the guide wall portion and an axial front-end wall portion of the fan casing. Air blown out from the bladed wheel flows through an air blow-out passage, wherein sound wave of the air from the bladed wheel and sound wave of the air from the air reflecting space interfere with each other so that noise is decreased.

7 Claims, 6 Drawing Sheets

(56) References Cited

U.S. PATENT DOCUMENTS

| | | | | |
|---|---|---|---|---|
| 5,919,030 | A * | 7/1999 | Iwatake | F04D 29/665 415/119 |
| 6,964,555 | B2 * | 11/2005 | Ochiai | F01D 9/026 415/204 |
| 7,883,312 | B2 * | 2/2011 | Eguchi | F04D 29/162 415/119 |
| 2002/0131861 | A1 | 9/2002 | Sakai et al. | |
| 2004/0131465 | A1 | 7/2004 | Ochiai et al. | |
| 2008/0233856 | A1 | 9/2008 | Okawa et al. | |
| 2008/0279681 | A1 * | 11/2008 | Eguchi | F04D 29/282 415/206 |
| 2013/0052049 | A1 | 2/2013 | Fujimoto et al. | |
| 2018/0149158 | A1 | 5/2018 | Ishii et al. | |
| 2018/0169359 | A1 * | 6/2018 | Higashiyama | F04D 27/004 |
| 2019/0366798 | A1 * | 12/2019 | Kosaka | B60H 1/00021 |

FOREIGN PATENT DOCUMENTS

| | | | | |
|---|---|---|---|---|
| FR | 2216540 | A1 * | 8/1974 | F04D 17/02 |
| JP | 2001-165097 | A | 6/2001 | |
| JP | 2001-349298 | A | 12/2001 | |
| JP | 2004-204756 | A | 7/2004 | |
| JP | 4026366 | B2 | 12/2007 | |
| JP | 2008-106645 | A | 5/2008 | |
| JP | 2008-265717 | A | 11/2008 | |
| JP | 2011-226407 | A | 11/2011 | |
| JP | 2012-021431 | A | 2/2012 | |
| JP | 2013-47483 | A | 3/2013 | |
| WO | WO-2016/181821 | A1 | 11/2016 | |

* cited by examiner

AXIAL OUTLET CENTRIFUGAL-TYPE BLOWER DEVICE WITH NOISE REDUCING SPACE

CROSS REFERENCE TO RELATED APPLICATION

This application is based on Japanese Patent Application No. 2018-73957 filed on Apr. 6, 2018, the disclosure of which is incorporated herein by reference.

FIELD OF TECHNOLOGY

The present disclosure relates to a centrifugal-type blower device.

BACKGROUND

A centrifugal-type blower device is known in the art. In one of prior arts, the blower device has a cylindrical housing and an electric motor coaxially arranged with and accommodated in the cylindrical housing. The blower device further has a bladed wheel movably accommodated in the cylindrical housing and connected to the electric motor, wherein the bladed wheel blows out air sucked from an air inlet port formed at a front side of the cylindrical housing to an outside of the bladed wheel in a radial direction. An air blow-out passage is formed in the cylindrical housing for guiding the air from the bladed wheel in an axial direction to a rear side of the cylindrical housing. The blower device has a bell mouth formed at the front side of the cylindrical housing for introducing the air into an inside of the blower device. Noise is generated by the air flowing through the air blow-out passage in an axial direction.

SUMMARY OF THE DISCLOSURE

The present disclosure is made in view of the above point. It is an object of the present disclosure to provide a centrifugal-type blower device, which can reduce noises.

According to one of features of the present disclosure, a blower device includes a fan casing, a bladed wheel movably accommodated in the fan casing, an electric motor for rotating the bladed wheel, a bell mouth portion formed at an axial-front side of the fan casing. Air is sucked into the bladed wheel through an inlet-side opening portion formed in the bell mouth portion, so that the air flows into the bladed wheel in an axial direction. The air is blown out from the bladed wheel in a radial direction to an air blow-out passage, which is formed in the fan casing at a radial-outside position of the bladed wheel. An air reflecting space is formed in the fan casing at a front side of the air blow-out passage. The air from the bladed wheel and the air from the air reflecting space flow together through the air blow-out passage, wherein sound waves are interfered with each other to thereby decrease noise to be generated by the air flowing through the air blow-out passage.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
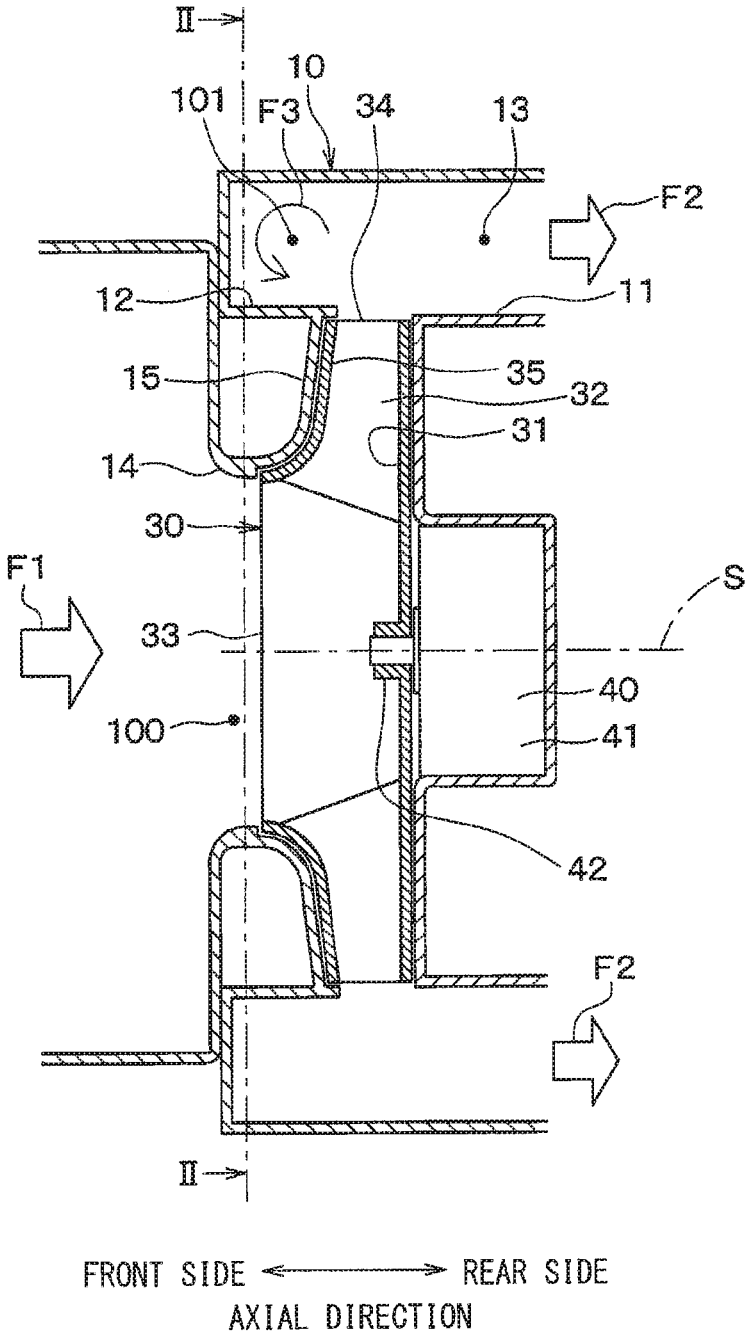
FIG. 1 is a schematic cross-sectional view showing a centrifugal-type blower device according to a first embodiment of the present disclosure.

The present disclosure will be explained hereinafter by way of multiple embodiments and/or modifications with reference to the drawings. The same reference numerals are given to the same or similar structures and/or portions in order to avoid repeated explanation.

First Embodiment

A centrifugal-type blower device (hereinafter, the blower device) according to a first embodiment of the present disclosure will be explained with reference to FIGS. 1 to 4. The blower device is applied to, for example, a motor-driven blower device for an air conditioning apparatus of an automotive vehicle. The blower device is composed of, for example, a turbofan device of a high static pressure, which includes an electric motor 40, a bladed wheel 30, a fan casing 10 and so on. Each of the fan casing 10 and the bladed wheel 30 is made of resin or metal.

The bladed wheel 30 has a main plate 31 of a disc shape, a side plate 35 of a doughnut shape and multiple fan blades 32 provided between the main plate 31 and the side plate 35 in an axial direction of the blower device (that is, a direction in parallel to a center axis line S). In other words, the side plate 35 supports each axial end of the fan blades 32 on a left-hand side thereof in FIG. 1 (an axial front-side end), while the main plate 31 supports each axial other end of the fan blades 32 on a right-hand side thereof in FIG. 1 (an axial rear-side end).

Figure 2:
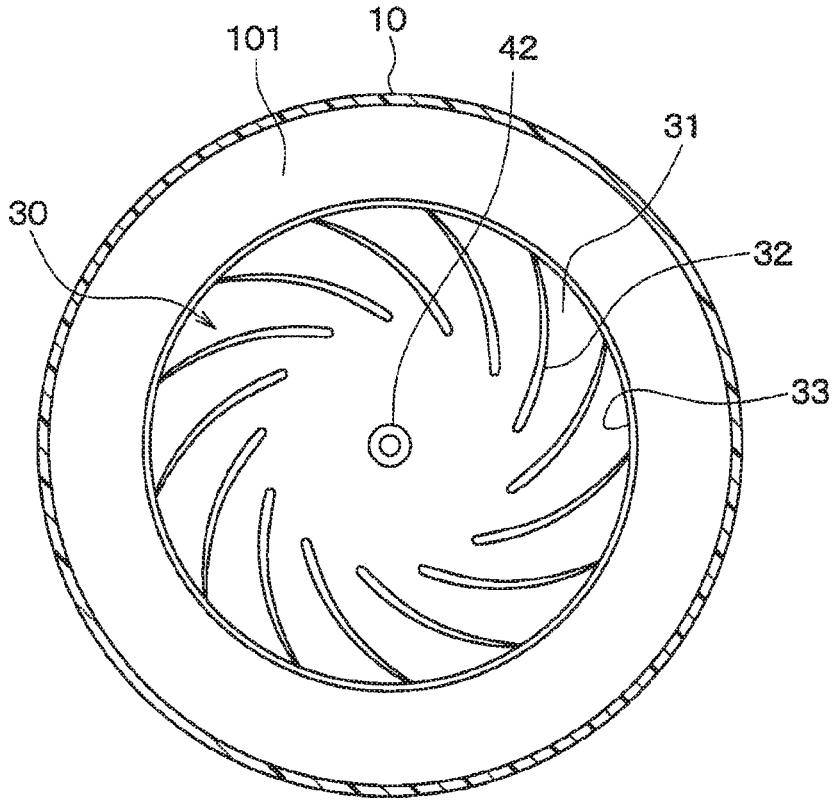
FIG. 2 is a schematic cross-sectional view taken along a line II-II in FIG. 1.

Each of the fan blades 32 is arranged at a position separated from the center axis line S in a radial direction of the blower device (perpendicular to the center axis line S). The multiple fan blades 32 are further arranged at equal intervals in a circumferential direction of the bladed wheel 30, as shown in FIG. 2.

An air inlet port 33 is formed at a center of the side plate 35. In a cross section of the side plate 35, as shown in FIG. 1, the side plate 35 is curved in such a way that a radial-inside portion thereof (an axial front-side portion) is protruded in an axial front-side direction (in the direction to the left-hand side in FIG. 1), as each point of the radial-inside portion of the side plate 35 comes closer to the air inlet port 33. When the bladed wheel 30 is rotated around the center axis line S, the air is sucked into the bladed wheel 30 from the air inlet port 33 and blown out from air outlet ports 34, which are formed between the main plate 31 and the side plate 35. A rotating shaft 42 of the electric motor 40 is coaxially arranged with the center axis line S of the blower device.

The fan casing 10 is formed in a cylindrical shape and movably accommodates the bladed wheel 30 and firmly holds the electric motor 40. The fan casing 10 includes a bell mouth portion 14, a guide wall portion 15, an air-passage wall portion 11 and so on.

The bell mouth portion 14 forms an inlet-side opening portion 100, which is opened in the axial direction at a position adjacent to the axial front-side end of the bladed wheel 30 (on the left-hand side of FIG. 1), so that the air is introduced into the air inlet port 33 of the bladed wheel 30 in the axial direction from a front side to a rear side of the blower device (the left-hand side to the right-hand side in FIG. 1). The bell mouth portion 14 guides the air along its curved surface so that the air smoothly flows into the inlet-side opening portion 100. The inlet-side opening portion 100 is formed at a center of the bell mouth portion 14. The inlet-side opening portion 100 is formed in such a manner that an opening area thereof is gradually decreased in the axial direction from the left-hand side to the right-hand side.

The air-passage wall portion 11 includes an outside cylindrical wall portion 11*a*, an inside cylindrical wall portion 11*b* and an axial front-end wall portion 11*c*, to form an air blow-out passage 13. The air blow-out passage 13 guides the air, which is blown out from the air outlet ports 34 of the bladed wheel 30 in the radial direction, along an inner peripheral wall of the air blow-out passage 13 of the fan casing 10, so that the air flows through the air blow-out passage 13 in the axial direction to the rear side (the right-hand side of FIG. 1). The air from the air outlet ports 34 of the bladed wheel 30 flows through the air blow-out passage 13 and then the air is discharged to an outside of the fan casing 10 from an outlet-side opening portion (not shown) of the fan casing 10.

The guide wall portion 15 extends in a radial-outward direction from an axial rear-side end of the bell mouth portion 14 (a right-hand end) and extends along the side plate 35 of the bladed wheel 30 towards an outer periphery of the bladed wheel 30. The guide wall portion 15 is so curved as to extend in the radial-outward direction along a curved shape of the side plate 35. In a cross section of the guide wall portion 15, a front-side part thereof is curved in such a way that it is protruded in the axial front-side direction, as each point of the front-side part comes closer to a position adjacent to the air inlet port 33.

In the blower device of the present embodiment, an air reflecting space 101 is formed in the fan casing 10 at a radial-outside position of the bell mouth portion 14 and the guide wall portion 15 and at an axial front-side position of the fan casing 10, which is on the left-hand side from the outer periphery of the side plate 35 of the bladed wheel 30. Noises, which may be generated by the air outputted from the air outlet ports 34 of the bladed wheel 30 and flowing through the air blow-out passage 13, can be reduced by interference of sound waves between the air from the air outlet ports 34 and the air from the air reflecting space 101.

Figure 3:
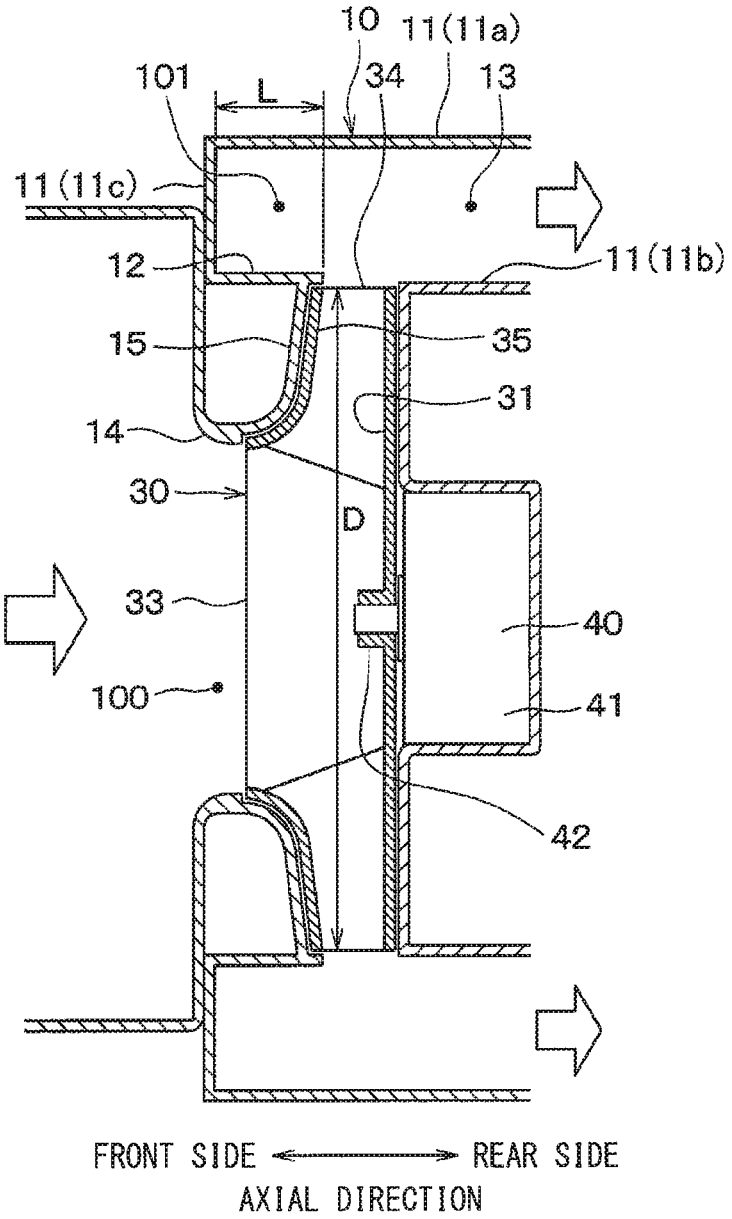
FIG. 3 is a schematic cross-sectional view of the blower device showing a relationship between an axial length "L" of an air reflecting space and a diameter "D" of a bladed wheel.

As shown in FIG. 3, a relationship of "$0.2\times D<L<0.35\times D$" is satisfied in the present embodiment, wherein "D" is a diameter of the bladed wheel 30 and "L" is an axial length of the air reflecting space 101.

The electric motor 40 drives the rotating shaft 42 to rotate the bladed wheel 30. The electric motor 40 of the present embodiment is composed of, for example, a direct-current motor, a brushless motor or the like. The electric motor 40 has a motor portion 41 and the rotating shaft 42. The motor portion 41 is accommodated in and fixed to the fan casing 10. More exactly, the motor portion 41 is fixed to the fan casing 10 in such a manner that a center axis of the rotating shaft 42 coincides with a center axis of the fan casing 10 (the center axis line S). The motor portion 41 rotates the rotating shaft 42. The main plate 31 of the bladed wheel 30 is connected to the rotating shaft 42, so that the bladed wheel 30 is rotated together with the rotating shaft 42.

An operation of the blower device of the present embodiment will be explained hereinafter.

When electric power is supplied to the electric motor 40 from an electric power source (not shown), the rotating shaft 42 is rotated. Then, the bladed wheel 30 is rotated together with the rotating shaft 42 around the center axis line S.

The air flows into the inlet-side opening portion 100 in the axial direction from the front side to the rear side (from the left-hand side to the right-hand side), as indicated by an arrow F1, when the bladed wheel 30 is rotated. The air smoothly flows into the inlet-side opening portion 100 along the bell mouth portion 14.

The air passing through the inlet-side opening portion 100 further flows through multiple spaces formed between the main plate 31 and the side plate 35 and divided by the multiple fan blades 32. The air is outputted in the radial-outward direction from each of the air outlet ports 34 formed between the main plate 31 and the side plate 35. The air from the air outlet ports 34 flows through the air blow-out passage 13 formed by the inner peripheral wall of the fan casing 10 and flows in the axial direction from the left-hand side to the right-hand side. The air is finally discharged to the outside of the fan casing 10 of the blower device through the outlet-side opening portion (not shown) formed in the fan casing 10.

As explained above, the air reflecting space 101 is formed in the fan casing 10 not only at the radial-outside position of the bell mouth portion 14 and the guide wall portion 15 but also at the axial front-side position between an axial rear-side end of the guide wall portion 15 (a right-hand end) and the axial front-end wall portion 11*c* of the fan casing 10 in the axial direction (at least between the right-hand and the left-hand ends of the guide wall portion 15 in the axial direction). The air reflecting space 101 functions as a side branch pipe of a silencer of a side-branch type. For example, in a case that the silencer of the side-branch type is applied to an internal combustion engine, a side branch pipe having a closed end is provided at an intermediate position of an exhaust pipe, in order to decrease sound of a specific frequency by interference between a sound wave directly transmitting in the exhaust pipe and a sound wave returning from the side branch pipe.

As a result that the air reflecting space 101 working as the side branch pipe is formed in the fan casing 10 of the present embodiment, it is possible to reduce noises transmitting in the air blow-out passage 13 by the interference between the sound wave of the air outputted from the air outlet ports 34 and flowing through the air blow-out passage 13 and the sound wave of the air reflected at the axial front-end wall portion 11*c* of the fan casing 10 through the air reflecting space 101. More exactly, a part of the air passing through the air blow-out passage 13 is reflected in the air reflecting space 101 and thereby a phase of the sound wave is reversed, so that such air having the reversed phase cancels the noises of the air passing through the air blow-out passage 13.

In a comparison example of a centrifugal-type blower device, in which a structure corresponding to the guide wall portion 15 is not formed, a structure corresponding to the side branch pipe is correspondingly not formed. In other words, the blower device of such a comparison example does not have a function for the silencer of the side-branch type. Therefore, an effect for decreasing the noises by the interference of the sound wave cannot be expected.

In addition, in the blower device of the above comparison example having no guide wall portion, an air turbulence is generated in a space formed in a fan casing at a radial-outside position of a bell mouth portion (that is, a space formed in the axial direction between the side plate of the bladed wheel and the bell mouth portion when a bladed wheel is rotated. Then, the noises are generated by such air turbulence.

On the other hand, in the blower device of the present embodiment, the guide wall portion 15 is provided in the fan casing 10. The air reflecting space 101 is formed by a part of the outside cylindrical wall portion 11*a*, the axial front-end wall portion 11*c* and a connecting wall portion 12 (explained below) at the front side of the fan casing 10. More exactly, the air reflecting space 101 is formed in an annular shape formed at the radial-outside position of the bladed wheel 30 to surround the same (at least, at the radial-outside of the side plate 35 of the bladed wheel 30). The air reflecting space 101 is so formed as to extend in the axial front-side direction from the right-hand side to the left-hand side, that is, in an opposite direction to an axial rear-side direction in which the air blow-out passage 13 extends. The air reflecting space 101 works as the side-branch pipe. Accordingly, the noise generation is suppressed by the interference between the sound wave of the air outputted from the air outlet ports 34 and passing through the air blow-out passage 13 and the sound wave of the air reflected in the air reflecting space 101.

In addition, since the guide wall portion 15 is formed inside of the fan casing 10, it is possible to prevent by the guide wall portion 15 a large disturbance of the air in the air reflecting space 101 when the bladed wheel 30 is rotated. As shown by an arrow F3 in FIG. 1, a stable swirl flow of the air is formed in the air reflecting space 101. As above, the noises can be further decreased.

As shown in FIG. 3 and explained above, the relationship of "$0.2\times D<L<0.35\times D$" is satisfied, wherein "D" is the diameter of the bladed wheel 30 and "L" is the axial length of the air reflecting space 101 in the axial direction (a distance between the axial front-end wall portion 11*c* and the axial rear-side end (the right-hand end) of the guide wall portion 15). A sound decreasing effect can be obtained in a frequency range having a center frequency, which is obtained by a calculating formula of "f (frequency)=c/4×L", wherein "c" is a sound speed and "L" is the axial length of the air reflecting space 101.

Figure 4:
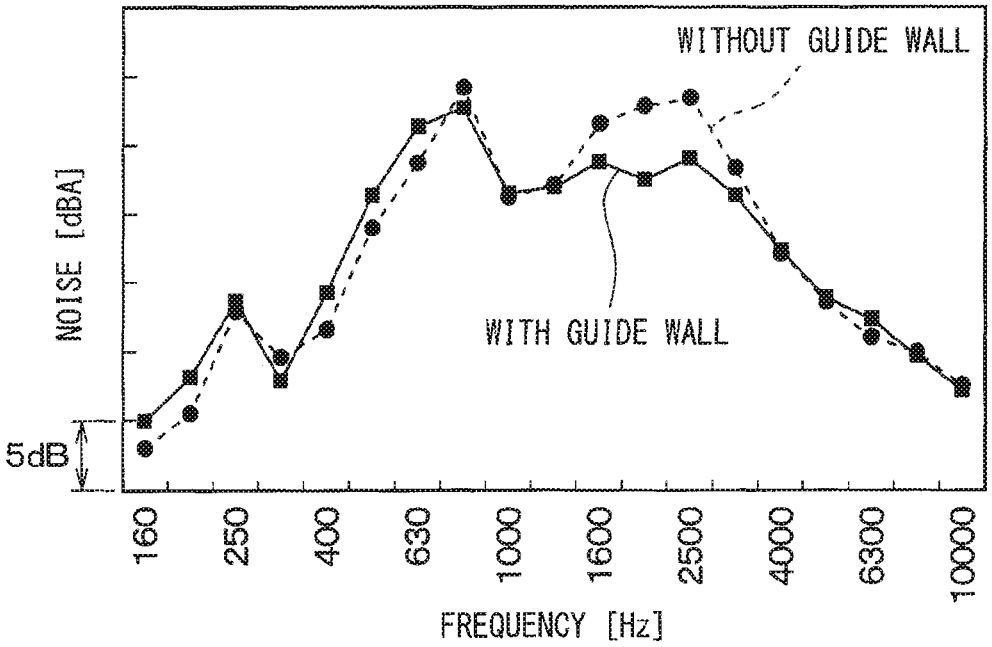
FIG. 4 is a graph showing noise generated by the blower device having a guide wall portion of the first embodiment and noise generated by a centrifugal-type blower device having no guide wall portion of a comparison example.

As shown in FIG. 4, the blower device of the present embodiment having the guide wall portion 15 has the sound decreasing effect in a frequency range between 1,400 Hz and 4,000 Hz, which is better than that of the blower device of the comparison example having no guide wall portion.

As above, the blower device of the present embodiment includes the bladed wheel 30, which has the main plate 31 supporting one of axial ends (the axial rear-side end) of each fan blade 32 and the side plate 35 supporting the other axial end (the axial front-side end) of the fan blade 32. The bladed wheel 30 of the blower device further includes the air outlet ports 34, each of which is formed between the main plate 31 and the side plate 35. The air is sucked into the bladed wheel 30 from the air inlet port 33 and outputted from the air outlet ports 34, when the bladed wheel 30 is rotated. The blower device further includes the fan casing 10 for rotatably accommodating the bladed wheel 30.

The fan casing 10 has the air-passage wall portion 11 for forming the air blow-out passage 13, which guides the air outputted from the air outlet ports 34 in the radial-outward direction so that the air flows along the inner peripheral wall of the fan casing 10 in the axial rear-side direction to the right-hand side in FIG. 1 or in other drawings. In addition, the fan casing 10 forms the inlet-side opening portion 100, which is opened in the axial front-side direction at the left-hand side of FIG. 1. Furthermore, the fan casing 10 has the bell mouth portion 14 in order to introduce the air into the air inlet port 33 of the bladed wheel 30 in the axial rear-side direction from the left-hand side.

In addition, the fan casing 10 has the guide wall portion 15, which extends in the radial-outward direction from the right-hand end of the bell mouth portion 14 to the outer periphery of the bladed wheel 30 along the side plate 35 of the bladed wheel 30.

The air reflecting space 101 is formed inside of the fan casing 10 at the radial-outside position of the bell mouth portion 14 and the guide wall portion 15 and at the axial front-side position of the fan casing 10 at least between the right-hand side end and the left-hand side end of the guide wall portion 15 in the axial direction. According to the above structure, it is possible to suppress the noise generation, by the air reflecting space 101, through the interference of the sound waves between the air outputted from the air outlet ports 34 of the bladed wheel 30 and flowing through the air blow-out passage 13 and the air outputted from the air outlet ports 34 and reflected in the air reflecting space 101.

As above, it is possible in the present embodiment to more effectively decrease the noises, because the air from the air outlet ports 34 and the air reflected in the air reflecting space 101 are interfered with each other and thereby the generation of the noises can be suppressed by the interference of the sound waves of the air flowing through the air blow-out passage 13.

The air reflecting space 101 has the annular shape in a cross section on a plane perpendicular to the center axis line S. Since the air reflecting space 101 is formed in the annular shape, it is possible to decrease the noise generation in the fan casing 10 at any circumferential position surrounding the outer periphery of the bladed wheel 30 in the circumferential direction.

In addition, the fan casing 10 has the connecting wall portion 12, which extends in the axial direction and connects the axial rear-side end (the right-hand end) of the guide wall portion 15 to the axial front-end wall portion 11*c* (the left-hand end) of the fan casing 10. As a result, the air reflecting space 101 is formed in the fan casing 10 by the outside cylindrical wall portion 11*a*, the axial front-end wall portion 11*c* and the connecting wall portion 12.

As above, it is possible to easily form the air reflecting space 101 by the fan casing 10, which includes the outside cylindrical wall portion 11*a*, the axial front-end wall portion 11*c* and the connecting wall portion 12.

In the present embodiment, the relationship of "$0.2\times D<L<0.35\times D$" is satisfied, wherein "D" is the diameter of the bladed wheel 30 and "L" is the axial length of the air reflecting space 101.

According to the above structure, it is possible in the blower device of the present embodiment to effectively suppress the noise to be generated by the air outputted from the air outlet ports 34 of the bladed wheel 30 and flowing through the air blow-out passage 13, wherein the noise has a peak frequency range between 1.25 kHz and 2.0 kHz.

Second Embodiment

Figure 5:
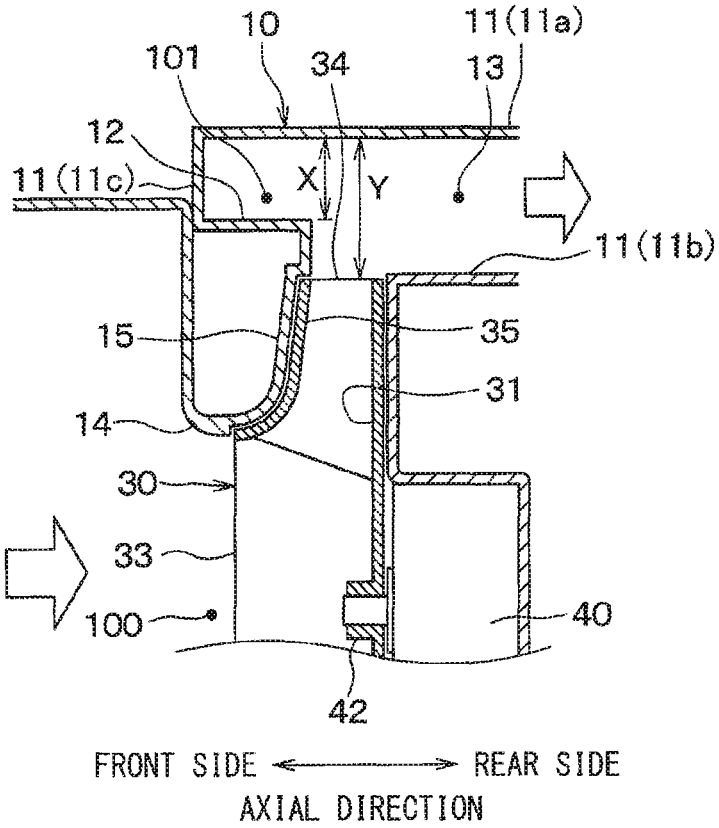
FIG. 5 is a schematic cross-sectional view showing a centrifugal-type blower device according to a second embodiment of the present disclosure and showing a relationship between a radial distance "X" of the air reflecting space and a radial distance "Y" of an air blow-out passage.

A centrifugal-type blower device (hereinafter, the blower device) according to a second embodiment will be explained with reference to FIG. 5. The blower device of the second embodiment is different from that of the first embodiment in a shape of the connecting wall portion 12. More exactly, the connecting wall portion 12 has a first wall part and a second wall part. The first wall part extends in the radial-outward direction from the axial rear-side end of the guide wall portion 15. The second wall part extends from a radial-outside end of the first wall part in the axial front-side direction from the right-hand side to the left-hand side. An axial front-side end (the left-hand side end) of the second wall part is connected to the axial front-end wall portion 11*c* of the fan casing 10.

In the blower device of the present embodiment, a radial length of the air reflecting space 101 in the radial direction, that is, a radial distance between the outside cylindrical wall portion 11*a* of the fan casing 10 and the connecting wall portion 12 is designated by "X", while a radial length (a radial distance) between the outside cylindrical wall portion 11*a* of the fan casing 10 and the air outlet port 34 of the bladed wheel 30 is designated by "Y". In the present embodiment, the radial distance "X" is made to be smaller than the radial distance "Y". According to the above structure, it is possible to more effectively suppress the generation of the disturbance of the air in the air reflecting space 101 and to suppress the generation of the noise.

Third Embodiment

Figure 6:
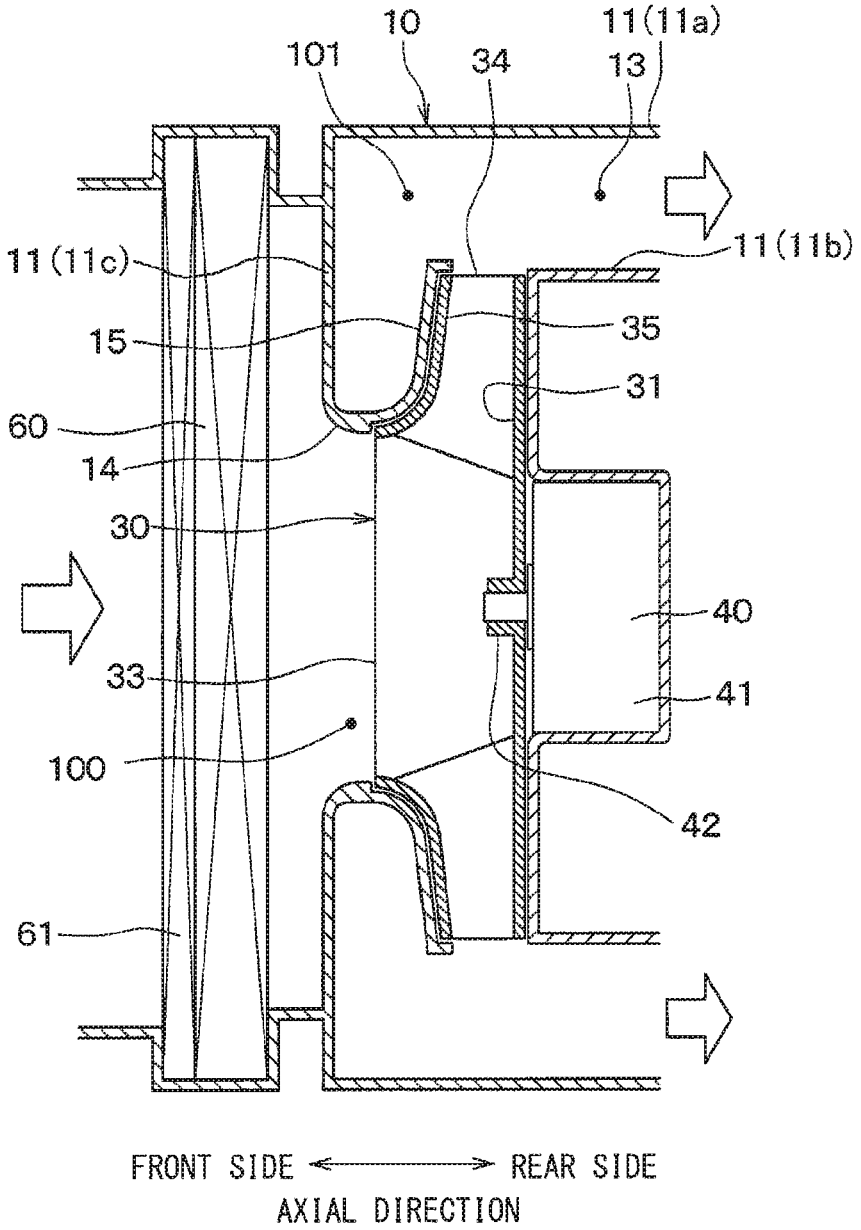
FIG. 6 is a schematic cross-sectional view showing a centrifugal-type blower device according to a third embodiment of the present disclosure.

A centrifugal-type blower device (hereinafter, the blower device) according to a third embodiment will be explained with reference to FIG. 6. The blower device of the third embodiment is different from that of the first embodiment in that a wall structure corresponding to the connecting wall portion 12 is not provided between the axial rear-side end of the guide wall portion 15 and the axial front-end wall portion 11*c* of the fan casing 10. Therefore, a part of the air reflecting space 101 is also formed between the bell mouth portion 14 and the guide wall portion 15.

In the present embodiment, an evaporator 60 (a cooling heat exchanger) and a filter 61 (for removing extraneous material, such as dust or the like) are provided at an upstream side of the inlet-side opening portion 100 of the fan casing 10. The extraneous material is removed from the air by the filter 61 and the air is cooled down by the evaporator 60. The air is then introduced into the inlet-side opening portion 100 of the fan casing 10.

As above, in the blower device of the present embodiment, the structure corresponding to the connecting wall portion 12 is not provided in the fan casing 10. As a result, it is possible to make a volume of the air reflecting space 101 larger. In addition, since the connecting wall portion 12 is not provided in the fan casing 10, it is possible to effectively make use of a dead space, which corresponds to a space surrounded by the bell mouth portion 14, the guide wall portion 15 and the connecting wall portion 12 in the first embodiment. It is therefore possible to further increase the silencing effect without making a size of the fan casing 10 larger.

Fourth Embodiment

Figure 7:
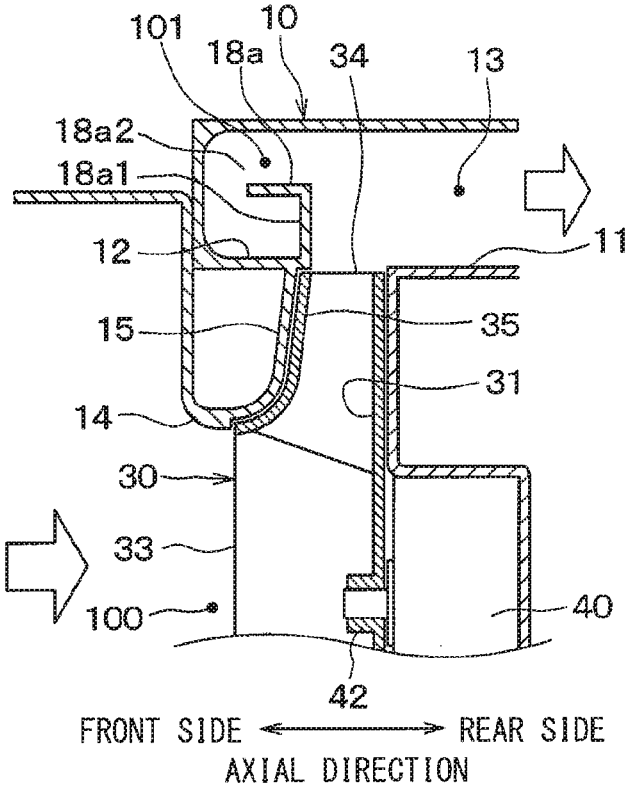
FIG. 7 is a schematic cross-sectional view showing a centrifugal-type blower device according to a fourth embodiment of the present disclosure.

A centrifugal-type blower device (hereinafter, the blower device) according to a fourth embodiment will be explained with reference to FIG. 7. In the blower device of the present embodiment, a partitioning wall 18*a* is provided in the fan casing 10 for dividing the air reflecting space 101 into two small spaces. The partitioning wall 18*a* has a first partition portion 18*a*1 and a second partition portion 18*a*2. The first partition portion 18*a*1 extends in the radial-outward direction from the axial rear-side end (the right-hand end) of the guide wall portion 15. The second partition portion 18*a*2 extends from a radial-outside end of the first partition portion 18*a*1 in the axial front-side direction from the right-hand side to the left-hand side. An axial length of the second partition portion 18*b*2 is smaller than that of the connecting wall portion 12.

The air reflecting space 101 is divided by the partitioning wall 18*a* into two small spaces, that is, a radial-outside space and a radial-inside space which are communicated to each other in the radial direction. The sound of the air is transmitted in the air reflecting space 101, while it goes around the partitioning wall 18*a* from the radial-outside space to the radial-inside space. As above, a sound pathway in the air reflecting space 101, in which the sound is transmitted, can be made longer. Therefore, it is possible to decrease the sound noise having a lower frequency.

According to the present embodiment, since the fan casing 10 has the partitioning wall 18*a* for dividing the air reflecting space 101 into the radial-outside space and the radial-inside space, it is possible to make the sound pathway in the air reflecting space 101 longer. As above, the sound noise having the lower frequency can be decreased.

Fifth Embodiment

Figure 8:
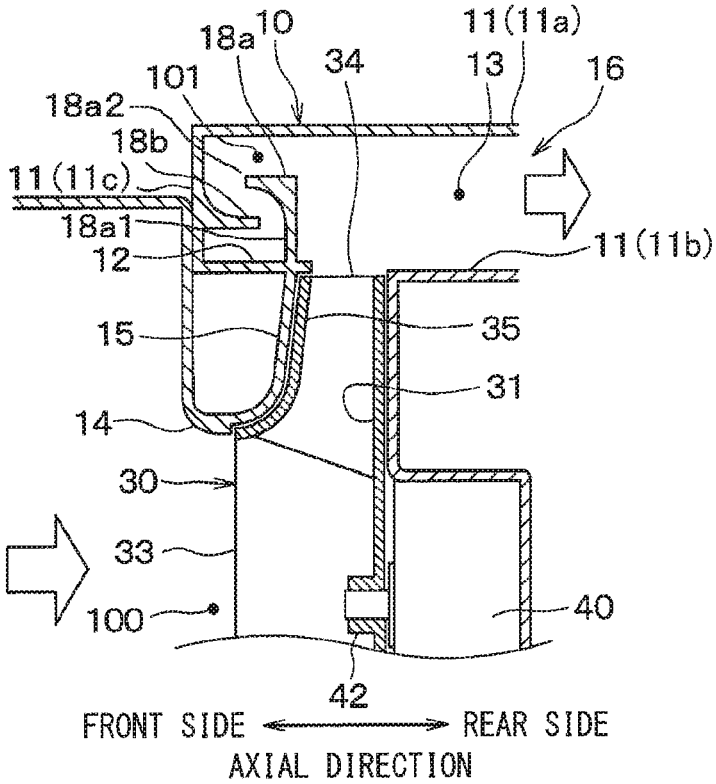
FIG. 8 is a schematic cross-sectional view showing a centrifugal-type blower device according to a fifth embodiment of the present disclosure.

A centrifugal-type blower device (hereinafter, the blower device) according to a fifth embodiment will be explained with reference to FIG. 8. In the blower device of the present embodiment, a first partitioning wall 18*a* and a second partitioning wall 18*b* are provided in the fan casing 10 for dividing the air reflecting space 101 into three small spaces.

In a similar manner to the fourth embodiment (FIG. 7), the first partitioning wall 18*a* has the first partition portion 18*a*1 and the second partition portion 18*a*2. The first partition portion 18*a*1 extends in the radial-outward direction from the axial rear-side end of the guide wall portion 15. The second partition portion 18*a*2 extends from the radial-outside end of the first partition portion 18*a*1 in the axial front-side direction. The axial length of the second partition portion 18*a*2 is smaller than that of the connecting wall portion 12 in the axial direction. The second partitioning wall 18*b* extends from the axial front-end wall portion 11*c* of the fan casing 11 in the axial rear-side direction from the left-hand side to the right-hand side. An axial length of the second partitioning wall 18*b* is smaller than that of the connecting wall portion 12. A first radial distance between the connecting wall portion 12 and the second partition portion 18*a*2 of the first partitioning wall 18*a* is larger than a second radial distance between the connecting wall portion 12 and the second partitioning wall 18*b* in the radial direction.

The air reflecting space 101 is divided by the partitioning walls 18*a* and 18*b* into three small spaces, that is, a radial-outside space, a radial-middle space and a radial-inside space, which are communicated to one another in the radial direction. According to the above structure, it is possible to make the sound pathway in the air reflecting space 101 (in which the sound is transmitted through the respective small spaces) much longer than that in the fourth embodiment (FIG. 7). Therefore, it is possible to decrease the sound noise having a much lower frequency. More exactly, it is possible to decrease the sound noise having the frequency between 600 Hz and 800 Hz, which may be discretely generated by a number of the fan blades 32 in particular when the air passes through the bladed wheel 30.

Further Embodiments and/or Modifications (1) In the above embodiments, the centrifugal-type blower device is applied to the electric blower unit for the air conditioning apparatus of the automotive vehicle. However, the blower device of the present disclosure can be applied to the blower unit of any other purposes.

(2) In the above fourth embodiment (FIG. 7), the partitioning wall 18*a* is provided to divide the air reflecting space 101 into two small spaces. In the fifth embodiment (FIG. 8), the first and the second partitioning walls 18*a* and 18*b* are provided to divide the air reflecting space 101 into three small spaces. The blower device may have multiple partitioning walls more than two.

The present disclosure is not limited to the above embodiments and/or modifications but can be further modified in various manners without departing from a spirit of the present disclosure.

What is claimed is:

1. A centrifugal-type blower device comprising;

(1) a bladed wheel including;

(1a) a main plate for supporting each one axial end of multiple fan blades;

(1 b) a side plate for supporting each other axial end of the multiple fan blades;

(1c) an air inlet port formed in the side plate for sucking air into the bladed wheel; and (1d) multiple air outlet ports formed between the main plate and the side plate for blowing out the air sucked from the air inlet port to an outside of the bladed wheel in a radial direction of the bladed wheel when the bladed wheel is rotated; and (2) a fan casing movably accommodating the bladed wheel and including;

(2a) an air-passage wall portion arranged at a radial-outside position of the bladed wheel and forming an air blow-out passage extending in an axial direction from a front side to a rear side of the blower device, the air blow-out passage being directly connected to the multiple air outlet ports, so that the air blown out from the air outlet ports in the radial direction flows through the air blow-out passage in the axial direction to the rear side along an inner peripheral wall surface of the air-passage wall portion, wherein the air blow-out passage has a front-side open end at its axial front side, the front-side open end having an annular cross-sectional shape on a plane perpendicular to the axial direction;

(2b) a bell mouth portion provided at a position adjacent to an axial-front side of the side plate and forming an inlet-side opening portion for introducing the air into the air inlet port of the bladed wheel in the axial direction from the front side to the rear side of the blower device;

(2c) a guide wall portion extending in a radial-outward direction of the blower device from an axial rear-side end of the bell mouth portion to a position adjacent to an outer periphery of the side plate; and (2d) an air reflecting space formed in an inside of the fan casing at a radial-outside position of the bell mouth portion and the guide wall portion and at an axial front-side position of the fan casing between an axial rear-side end of the guide wall portion and an axial front-side end of the guide wall portion, wherein the air reflecting space has a rear-side open end at its axial rear side, the rear-side open end having an annular cross-sectional shape on the plane perpendicular to the axial direction, wherein the air reflecting space is communicated to the air outlet ports of the bladed wheel via the rear-side open end of the annular cross-sectional shape, so that the air from the bladed wheel partly flows into the air reflecting space, and wherein the rear-side open end of the air reflecting space is directly communicated to the front-side open end of the air blow-out passage in the axial direction, so that not only the air from the bladed wheel but also the air from the air reflecting space flow together through the air blow-out passage in the axial direction, to thereby decrease noise of the air flowing through the air blow-out passage by interference of sound waves between the air from the bladed wheel and the air from the air reflecting space.

2. The centrifugal-type blower device according to claim 1, wherein the fan casing further includes a connecting wall portion for connecting in the axial direction the axial rear-side end of the guide wall portion to an axial front-end wall portion of the air-passage wall portion forming the air blow-out passage, and the air reflecting space is formed by an outside cylindrical wall portion of the air-passage wall portion, the axial front-end wall portion of the air-passage wall portion and the connecting wall portion.

3. The centrifugal-type blower device according to claim 2, wherein a radial distance of the air reflecting space between the outside cylindrical wall portion of the air-passage wall portion and the connecting wall portion in the radial direction is smaller than a radial distance of the air blow-out passage between the outside cylindrical wall portion and the air outlet port of the bladed wheel in the radial direction.

4. The centrifugal-type blower device according to claim 2, wherein a relationship of "$0.2\times D<L<0.35\times D$" is satisfied, wherein "D" is a diameter of the bladed wheel and "L" is an axial length of the air reflecting space in the axial direction.

5. The centrifugal-type blower device according to claim 1, wherein the fan casing further includes;

a partitioning wall for dividing the air reflecting space into two small spaces.

6. The centrifugal-type blower device according to claim 1, wherein the fan casing further includes;

a first partitioning wall and a second partitioning wall for dividing the air reflecting space into three small spaces.

7. A centrifugal-type blower device comprising;

(1) a bladed wheel including;

(1a) a main plate for supporting each axial rear-side end of multiple fan blades;

(1 b) a side plate for supporting each axial front-side end of the multiple fan blades;

(1c) an air inlet port formed in the side plate for sucking air into the bladed wheel; and (1d) multiple air outlet ports formed between the main plate and the side plate for blowing out the air sucked from the air inlet port to an outside of the bladed wheel in a radial direction of the bladed wheel when the bladed wheel is rotated; and (2) an electric motor for rotating the bladed wheel; and (3) a fan casing firmly holding the electric motor and movably accommodating the bladed wheel, wherein the fan casing includes;

(3a) an air-passage wall portion formed by an outside cylindrical wall portion, an inside cylindrical wall portion and an axial front-end wall portion, the air-passage wall portion being arranged at a radial-outside position of the bladed wheel and forming an air blow-out passage extending in an axial direction from a front side to a rear side of the blower device, the air blow-out passage being directly connected to the multiple air outlet ports, so that the air blown out from the air outlet ports in the radial direction flows through the air blow-out passage in the axial direction from the front side to the rear side of the blower device along an inner peripheral wall surface of the air-passage wall portion, wherein the air blow-out passage has a front-side open end at its axial front side, the front-side open end having an annular cross-sectional shape on a plane perpendicular to the axial direction;

(3b) a bell mouth portion provided at a position adjacent to an axial-front side of the side plate and forming an inlet-side opening portion for introducing the air into the air inlet port of the bladed wheel in the axial direction from the front side to the rear side of the blower device;

(3c) a guide wall portion extending in a radial-outward direction of the blower device from an axial rear-side end of the bell mouth portion to a position adjacent to an outer periphery of the side plate;

(3d) a connecting wall portion formed between an axial rear-side end of the guide wall portion and the axial front-end portion; and (3e) an air reflecting space formed in an inside of the fan casing and surrounded by a part of the outside cylindrical wall portion, the axial front-end portion and the connecting wall portion, wherein the air reflecting space has a rear-side open end at its axial rear side, the rear-side open end having an annular cross-sectional shape on the plane perpendicular to the axial direction, (3f) the air reflecting space being located at a radial-outside position of the bell mouth portion and the guide wall portion and at an axial front-side position of the fan casing at least between the axial rear-side end of the guide wall portion and an axial front-side end of the guide wall portion, (3g) the air reflecting space being communicated to the air outlet ports of the bladed wheel via the rear-side open end of the annular cross-sectional shape, so that the air from the bladed wheel partly flows into the air reflecting space, and (3h) the rear-side open end of the air reflecting space being directly communicated to the front-side open end of the air blow-out passage in the axial direction, so that not only the air from the bladed wheel but also the air from the air reflecting space flow together through the air blow-out passage in the axial direction, to thereby decrease noise of the air flowing through the air blow-out passage by interference of sound waves between the air from the bladed wheel and the air from the air reflecting space.

* * * * *